US008839862B2

(12) United States Patent
Hawker

(10) Patent No.: US 8,839,862 B2
(45) Date of Patent: Sep. 23, 2014

(54) METHOD OF STABILISING A BLASTHOLE

(75) Inventor: Robert Hawker, Nowra (AU)

(73) Assignee: Minova International Limited, Chesterfield (GB)

( * ) Notice: Subject to any disclaimer, the term of this patent is extended or adjusted under 35 U.S.C. 154(b) by 524 days.

(21) Appl. No.: 13/120,225

(22) PCT Filed: Sep. 24, 2009

(86) PCT No.: PCT/GB2009/051252

§ 371 (c)(1),
(2), (4) Date: Apr. 20, 2011

(87) PCT Pub. No.: WO2010/035038

PCT Pub. Date: Apr. 1, 2010

(65) Prior Publication Data

US 2011/0188946 A1 Aug. 4, 2011

(30) Foreign Application Priority Data

Sep. 24, 2008 (GB) ..... 0817501.0

(51) Int. Cl.

| | |
|---|---|
| ***E21B 33/138*** | (2006.01) |
| ***E02D 3/12*** | (2006.01) |
| ***C09K 17/40*** | (2006.01) |
| ***F24D 1/08*** | (2006.01) |

(52) U.S. Cl.

CPC ..... *F24D 1/08* (2013.01); *E21B 33/138* (2013.01)

USPC ..... 166/281; 166/295; 405/268

(58) Field of Classification Search

None

See application file for complete search history.

(56) References Cited

U.S. PATENT DOCUMENTS

| | | | | |
|---|---|---|---|---|
| 2,207,478 | A | | 7/1940 | Cameron, Sr. |
| 4,307,980 | A | | 12/1981 | Meyer et al. |
| 4,829,902 | A | * | 5/1989 | Sharpe et al. ..... 102/312 |
| 5,092,265 | A | | 3/1992 | Hughes et al. |
| 5,107,928 | A | | 4/1992 | Hilterhaus |
| 6,533,036 | B1 | | 3/2003 | Baret et al. |
| 6,702,044 | B2 | | 3/2004 | Reddy et al. |

(Continued)

FOREIGN PATENT DOCUMENTS

| | | | |
|---|---|---|---|
| CN | 1327187 C | * | 7/2007 |
| DE | 3202048 A | * | 7/1983 |

(Continued)

OTHER PUBLICATIONS

Minova Carbotech GMBH: "Resins for Mining" [Online], Sep. 4, 2007, http://web.archive.org/web/20070904124455/http://www.minova-ct.com/content.php?]ang=en&id=146>.

(Continued)

*Primary Examiner* — Zakiya W Bates

(74) *Attorney, Agent, or Firm* — Westman, Champlin & Koehler, P.A.; Z. Peter Sawicki; Amanda Prose

(57) ABSTRACT

A method of stabilizing a blasthole prior to detonation which comprises the step of coating the inner wall of the blasthole with a stabilizing composition. In one embodiment, the invention comprises coating the blast hole with a movable spraying application. The invention further relates to the use of a silicate-containing resin but is also suitable for use with a thermoset resin system. The method can be used to apply the stabilizing composition to both dry and wet blastholes.

20 Claims, 4 Drawing Sheets

(56) References Cited

U.S. PATENT DOCUMENTS

Figure 1:
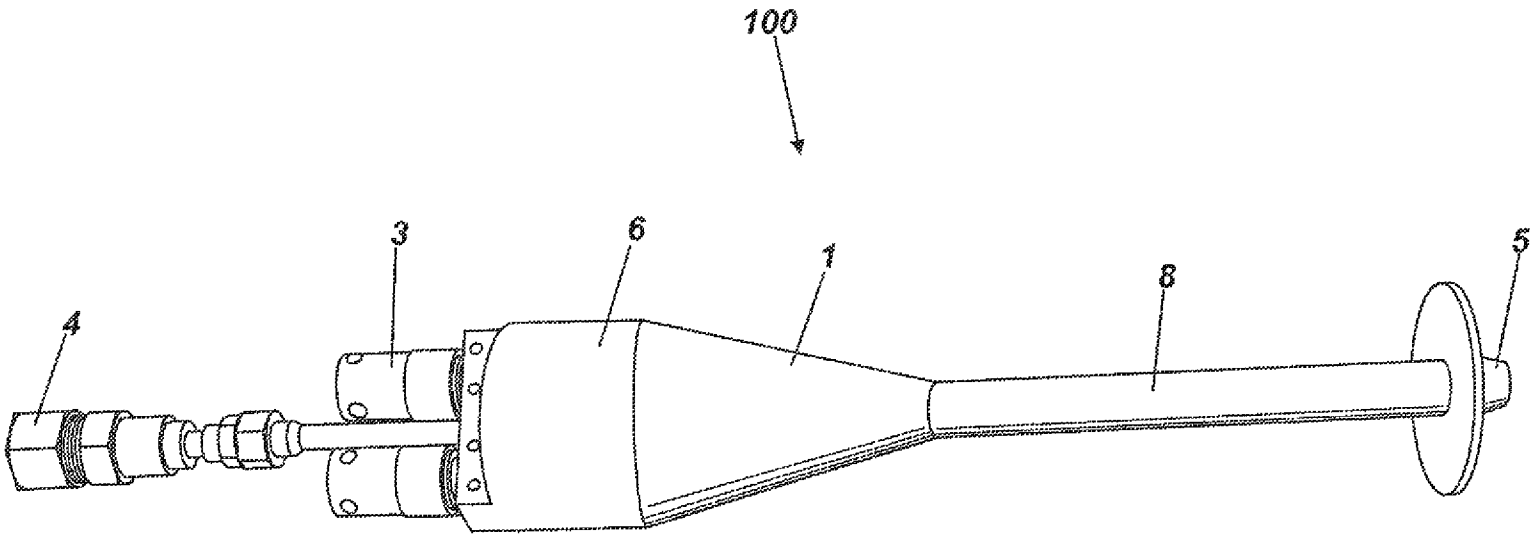

| | | | |
|---|---|---|---|
| 2002/0092808 | A1 | 7/2002 | Lauritzen et al. |
| 2003/0062166 | A1 | 4/2003 | Cheng et al. |
| 2003/0230431 | A1 | 12/2003 | Reddy et al. |
| 2004/0074645 | A1 | 4/2004 | Surjaatmadja |
| 2005/0284666 | A1 | 12/2005 | Cowan |
| 2007/0093566 | A1 | 4/2007 | Thompson-Colon et al. |
| 2008/0028994 | A1 | 2/2008 | Barlet-Gouedard et al. |
| 2008/0087431 | A1 | 4/2008 | Willauer et al. |

FOREIGN PATENT DOCUMENTS

| | | | | |
|---|---|---|---|---|
| EP | 0229425 | B1 | | 7/1987 |
| GB | 1336064 | | | 11/1973 |
| RU | 2291391 | C1 | | 10/2009 |
| SU | 1285140 | A | * | 1/1987 |
| SU | 735772 | | | 11/1987 |
| UA | 65446 | A | | 3/2004 |
| WO | 9854243 | A1 | | 12/1998 |
| WO | 02094903 | A1 | | 11/2002 |
| WO | 2005003678 | A2 | | 1/2005 |
| WO | 2005012456 | A1 | | 2/2005 |
| WO | 2008017414 | A1 | | 2/2008 |

OTHER PUBLICATIONS

PCT International Search Report, Dec. 9, 2009.
PCT Written Opinion, 2009.
UK Search Report, Nov. 18, 2008.

* cited by examiner

METHOD OF STABILISING A BLASTHOLE

CROSS-REFERENCE TO RELATED APPLICATION

The present application is a Section 371 National Stage Application of and claims priority of International patent application Serial No. PCT/GB2009/051252, filed Sep. 24, 2009, and published in English the content of which is hereby incorporated by reference in its entirety.

The invention relates to a method of stabilising a blasthole prior to detonation and to a blasthole stabilisation kit.

During mining operations it is common to create bore holes extending either upwardly or downwardly from a working chamber. Such bore holes are intended to house explosives and are known as blastholes. These blastholes are typically up to 50 meters in length (most of which are within the range of 15 to 40 meters) and range in diameter from 50 mm to 120 mm (approximate sizes are for example: 64 mm, 76 mm, 89 mm, 102 mm and 109 mm) and are useful in forming raises, blasting to adjacent raises, or for block caving. Suitable blastholes are prepared by drilling with conventional rock drills to leave a cylindrical blasthole, defined by cylindrical walls of the drilled rock structure, within which explosives are placed for subsequent detonation.

Freshly drilled underground blastholes are generally very strong because of their circular shape. However, geology, stress and hole orientation can lead to fretting of blastholes and wedges of rock can be displaced, causing a blockage within the hole. Distortion of the blasthole causes a number of disadvantages, for example, the blasthole volume can be reduced or the hole may be closed to the point where the blasthole cannot be loaded with explosives. In these instances, the blastholes must be cleared (e.g. using compressed air or water), re-drilled or left unloaded. In any event, there is a significant increase in cost. If blastholes need to be re-drilled, including clearing of debris from the holes, there is significant disruption to normal production drilling and loss of drilling capacity. Unloaded blastholes result in overburdening of later fired blastholes and could lead to bridges or oversize rock that can block or disrupt ore-flow through drawpoints, overbreak at stope limits and other disadvantages.

It is common for underground mines to drill rings of blastholes which may be left open and unblasted for as much as 12 months. Therefore, mine operations require a method of protecting or stabilising drilled blastholes until the time that they are prepped for blasting.

Therefore, according to a first aspect of the invention there is provided a method of stabilising a blasthole prior to detonation which comprises the step of coating the inner wall of the blasthole with a stabilising composition after the blast hole has been drilled.

It will be appreciated that references to "stabilising" herein refer to the minimisation or prevention of dislodging of material and rock from within the blasthole and enhancing the structural integrity of the blasthole.

In one embodiment, the coating step comprises spraying. In one embodiment, spraying comprises an airless spray system. It will be readily apparent to the skilled person that an airless spray system comprises a spray system which avoids the use of air at the spray tip or point of atomization. An airless spray system forces the composition at high pressure through the spray tip to create particle break-up or atomization. In an alternative embodiment, spraying comprises the use of a source of compressed gas (i.e. compressed air). In a further embodiment, the coating step comprises spraying a solution (e.g. a liquid or aqueous solution) of the stabilising composition which solidifies following contact with the inner wall of the blasthole. This embodiment provides the advantage of allowing application of the stabilising composition to blastholes which are either drilled downwards or upwards. For example, the problem with applying a liquid composition to a blasthole which has been drilled upwards is that the composition will typically drain from the blasthole resulting in wasteage and insufficient blasthole stabilisation. Therefore, use of a solidifying composition provides the significant advantage of remaining in place upon the inner wall of the blasthole even when the hole has been drilled in an upwards direction.

Blastholes may be wet in nature which arises from water inflow from above or below the collar or due to water weeping through porous material or via joints or other planes of weakness. One further advantage of the invention is enabling the stabilising composition to be applied to both dry and wet blastholes.

The invention particularly relates to the use of a silicate containing resin (e.g. a urea/silicate containing resin) as the stabilising composition for stabilising the blasthole. Such a silicate containing resin may be prepared by mixing a first composition comprising sodium silicate with a second composition comprising modified polyisocyanate (e.g. polymeric diphenylmethane diisocyanate). In a further embodiment, the silicate containing resin comprises a composition as described in WO 02/094903, the compositions of which are herein incorporated by reference.

In one embodiment, the first composition comprising sodium silicate additionally comprises silane compounds (e.g. 0.05-5% w/w) containing at least two primary and/or secondary amine groups. In a further embodiment, the first composition comprising sodium silicate additionally comprises silanols or their precursor compounds. In a yet further embodiment, the first composition comprising sodium silicate additionally comprises (3-(ethylene diamino)propyl)silanol or (3-(diethylene triamino)propyl)silanol). In a yet further embodiment, the first composition comprising sodium silicate additionally comprises (3-(ethylene diamino)trimethoxysilane or (3-(diethylene triamino)propyl)trimethoxysilane as precursor compound.

In a yet further embodiment the stabilising composition is Carbothix™ (formerly known as Geothix™). The Carbothix™ (Geothix™) composition provides the advantage of rapidly forming a gel to minimize and/or eliminate slumping off the side walls of the borehole. The gel consequently sets quickly to rapidly stabilise the borehole and again minimize and/or prevent slumping. Such rapid stabilization provides significant benefits in wet holes which are subjected to water ingress into the borehole.

In alternative embodiments, the stabilisation composition comprises a thermoset resin system which includes but is not limited to polyurethanes, polyesters, epoxides, or phenolics. Examples of thermoset resin mixtures are described in U.S. Pat. No. 6,702,044, the compositions of which are herein incorporated by reference. Further examples of stabilizing compositions include cement based mortars or materials. In a further alternative embodiment, the stabilising composition comprises a polymeric composition, such as a Geopolymer. Examples of geopolymeric materials are described in US 2008/0028994, the compositions of which are herein incorporated by reference.

The stabilising composition of the invention will generally comprise a mixture of two or more classes of substances which solidify upon mixing. In this method, the mixing step will typically immediately precede the coating step such that the stabilising composition is allowed to solidify (e.g. harden)

upon the inner wall of the blasthole for optimal stabilisation. In the embodiment wherein the stabilising composition comprises a thermoset resin system, the stabilising composition comprises a mixture of a resin base composition and a hardener composition. In the embodiment wherein the stabilising composition comprises a mortar containing composition, the stabilising composition comprises a mixture of sand and mortar.

Thus the methods of the invention comprise the use of a spraying apparatus which is capable of applying the stabilising composition to the inner wall of the blasthole. It will also be appreciated that the spraying apparatus will comprise separate chambers containing the resin base composition and the hardener composition. The apparatus will then feed the separate compositions through separate hoses to a static mixing chamber just behind a spray head. The two compositions are then mixed immediately prior to spraying (using a compressor device) in order to allow them to solidify upon the inner wall of the blasthole. It will be appreciated that the spray head may be configured to be replaced after spraying. Such a disposable arrangement provides the advantage of eliminating the need for the spray head to be flushed through following stabilization of the blasthole.

As described hereinbefore, alternative examples to the Carbothix™ (Geothix™) stabilising composition are envisaged and specific examples of which are provided herein. For example, in one alternative embodiment, the stabilising composition comprises a resin containing foam material (e.g. a phenolic resin containing foam material). Such a phenolic resin containing foam material may be prepared by mixing a first composition comprising a phenolic resin (e.g. Resole resin) and a carbonate containing compound (e.g. magnesium hydrogen carbonate) with a second composition comprising one or more acids (e.g. phenol sulfonic acid and sulphuric acid). In a further embodiment, the phenolic resin containing foam material comprises a composition as described in WO 98/54243, the compositions of which are herein incorporated by reference. In a yet further embodiment the stabilising composition is Carbofill™.

It will be appreciated that the stabilizing composition should be selected to be compatible with the explosives used during detonation of the blasthole. Both Carbothix™ (Geothix™) and Carbofill™ have been tested and been found to be compatible with typical explosives used for detonation of blastholes.

It will be appreciated that in an alternative embodiment to spraying, the blasthole may be coated by filling with the stabilizing composition (e.g. with a foam substance, such as Carbofill™), however, unlike the spraying embodiment, such a process will require a secondary step of removal prior to loading the blasthole with explosives.

In one embodiment, the coating step comprises a moveable spraying application of the stabilising composition from a first position at the base of the blasthole to a second position at the opening of the blasthole. The method of the invention may comprise steps of:

(a) moving a source of stabilizing composition from a proximal end of the blast hole to a distal end; and (b) moving the source from the distal end to the proximal whilst operating the source to coat an inner wall of the blasthole with the stabilizing composition. This embodiment or step (b) is referred to as "retraction", i.e. retraction of the source or spraying apparatus from the base (or distal end) of the blasthole to the opening (or proximal end) of the blasthole. Such retraction will typically comprise the use of a motorised retraction device (e.g. a winch or a crane). This embodiment provides the advantage of being able to systematically coat the inner wall of a blasthole to provide a consistent depth of coating along the entire length of the blasthole. The advantage of movement from the base to the opening is that the spraying apparatus will be constantly moving away from the newly applied stabilising composition on the inner wall of the blasthole and is less likely to disrupt the integrity of the coating. During tests, the invention resulted in coating of an inner wall of a 3 meter long section of pipe in 15 seconds. This coating rate equates to 3 minutes to coat a 30 meter deep hole with a 3 mm thick coating of stabilising composition. Further tests have also demonstrated equivalent results of consistent spray patterns with pipe sections up to 24 meters in length.

In a further embodiment, the rate of spraying is variable and controllable. It will be appreciated that selection of a value for the spraying rate will be readily apparent to the skilled person depending upon the nature of the mixture applied and the internal bore diameter of the blasthole. For example, a specific spraying rate in liters/minute will be administered. In a preferred embodiment, the spraying rate is between 1 and 20 liters/minute (e.g. 10 liters/minute).

In a further embodiment, the movement between the first (distal) and second (proximal) positions (i.e. the retraction rate) is variable and controllable. It will be appreciated that selection of a value for the retraction rate will be readily apparent to the skilled person depending upon the nature of the mixture applied and the internal bore diameter of the blasthole. For example, a specific movement in meters/minute will be employed. In a preferred embodiment, the retraction rate is between 1 and 50 meters/minute, such as between 1 and 20 meters/minute (e.g. 10 meters/minute).

It will be appreciated that the control of the spraying and retraction parameters will enable the coating step to be performed to a consistent degree and to achieve uniform and consistent coating layers across the entire depth of the blasthole which may be as much as 30 meters. For example, generally the retraction rate will match the output spraying rate to ensure that the correct thickness of the stabilising composition is applied.

It will be appreciated that selection of a value for the desired thickness of the stabilising composition upon the inner wall of the blasthole will be readily apparent to the skilled person depending upon the nature of the mixture applied, the internal bore diameter of the blasthole and the general condition of the blasthole. However, in one preferred embodiment, the coating step comprises coating the inner wall of the blasthole with between 1 mm and 5 mm of the stabilising composition. In a further preferred embodiment, the coating step comprises coating the inner wall of the blasthole with between 2 mm and 4 mm (e.g. between 2 mm and 3 mm) of the stabilising composition. In the embodiment wherein the stabilising composition comprises a resin containing composition, a spraying rate of 10 liters/minute and a retraction rate of 10 meters/minute will typically provide a 2-3 mm coating of stabilising composition.

It will be appreciated that selection of the surface area of the inner wall of the blasthole to be coated with the stabilising composition will be readily apparent to the skilled person depending upon the nature of the mixture applied, the internal bore diameter of the blasthole and the general condition of the blasthole. In one embodiment, the inner wall of the blasthole is substantially coated with the stabilising composition. References to "substantially coated" refer to the coating of any one of (or at least any of) 60, 70, 80, 85, 90, 95, 98, 99 or 100% of the total internal surface area of the blasthole. In a further embodiment, between (or from) 99 and (or to) 100% of the surface area of the inner wall of the blasthole is coated with the stabilising composition.

It will be appreciated that the coating step may occur simultaneously with the drilling of the blasthole, however, in one embodiment, the coating step occurs after the blasthole has been drilled.

According to a further aspect of the invention there is provided a blasthole stabilisation kit which comprises a stabilising composition as hereinbefore defined and instructions to use said kit in accordance with the methods hereinbefore defined.

In one embodiment, the kit additionally comprises a spraying apparatus as hereinbefore defined. In a further embodiment, the spraying apparatus comprises separate chambers containing a first class of substances which solidify on mixing (e.g. a resin base composition or cement) and a second class of substances which solidify on mixing (e.g. a hardener composition or mortar). In a further embodiment, the spraying apparatus comprises means (for example a mixer, especially a static mixer) for mixing the resin base composition and a hardener composition. In a further embodiment, the spraying apparatus comprises a spray head (or spray tip) or nozzle. In a further embodiment, the spraying apparatus comprises means (for example a pump) for spraying the stabilising composition under high pressure (e.g. an air compressor device). The source of stabilizing composition may be the whole or part of the spraying apparatus; in particular, the source may be the spray head or spray tip. The mixing means (or mixer) may be located at the spray head such that the spray head is connected to each chamber by separate pipes or the mixing means (or mixer) may be located close to the chambers such that the spray head is connected to the mixing means by a single pipe. The former arrangement is advantageous when the pipes are long because of the length of the blasthole to be coated or because the substances which solidify on mixing react rapidly. The latter arrangement is advantageous when the pipes are shorter or because the substances which solidify on mixing react slowly or only solidify on contact with the atmosphere.

In one embodiment, the kit additionally comprises retraction means for retracting (or otherwise moving) the spraying apparatus (or at least the spray head) within the blasthole. In a further embodiment, the retraction means comprise a crane or a winch.

In one embodiment, the kit additionally comprises means to control the spraying and/or retraction rates.

Figure 2:
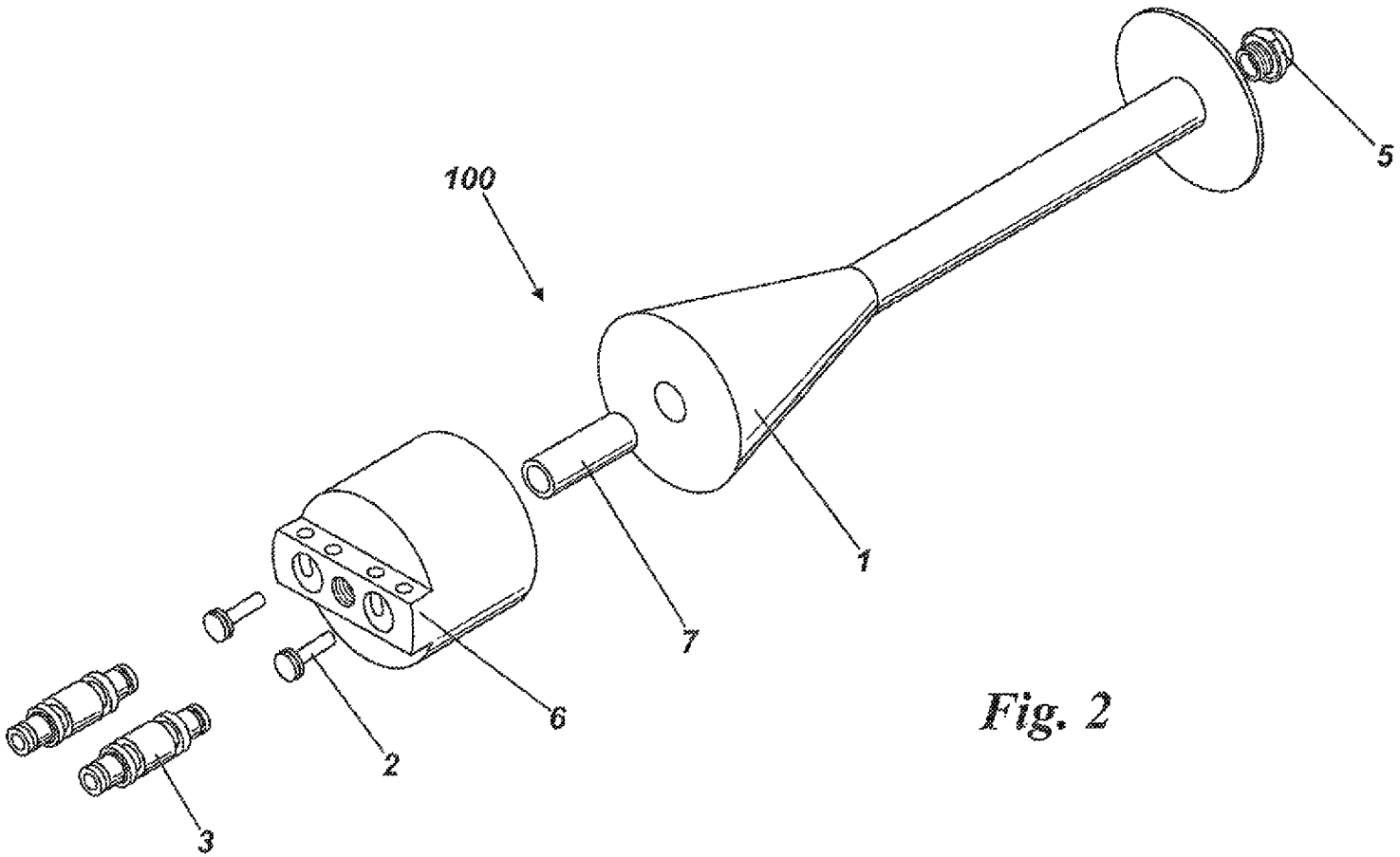
Figure 3:
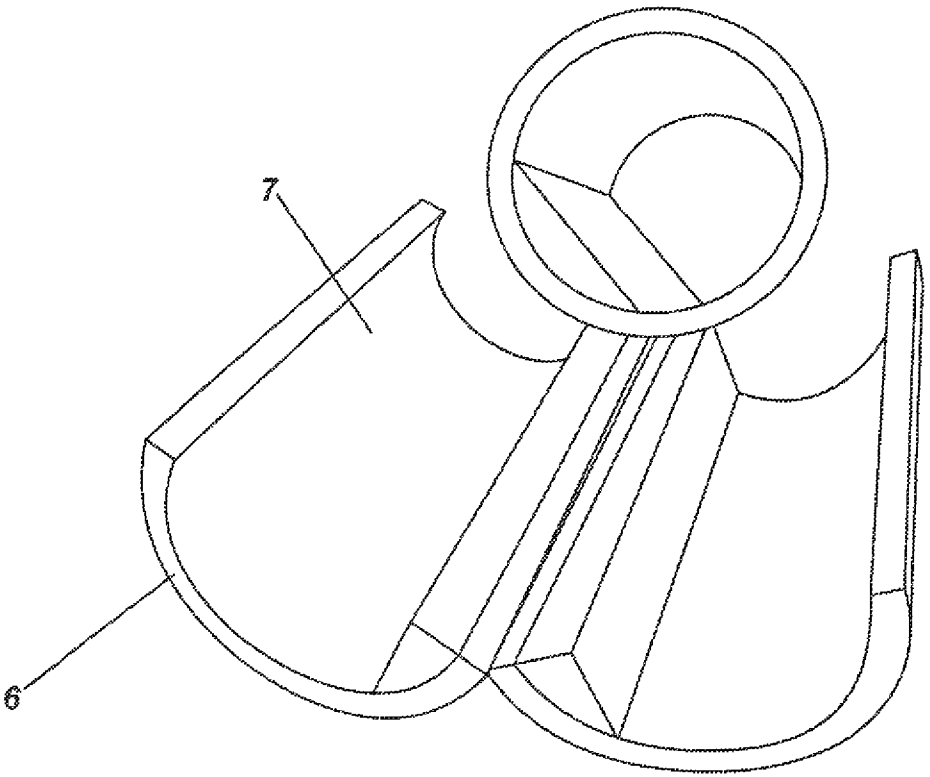
Figure 4:
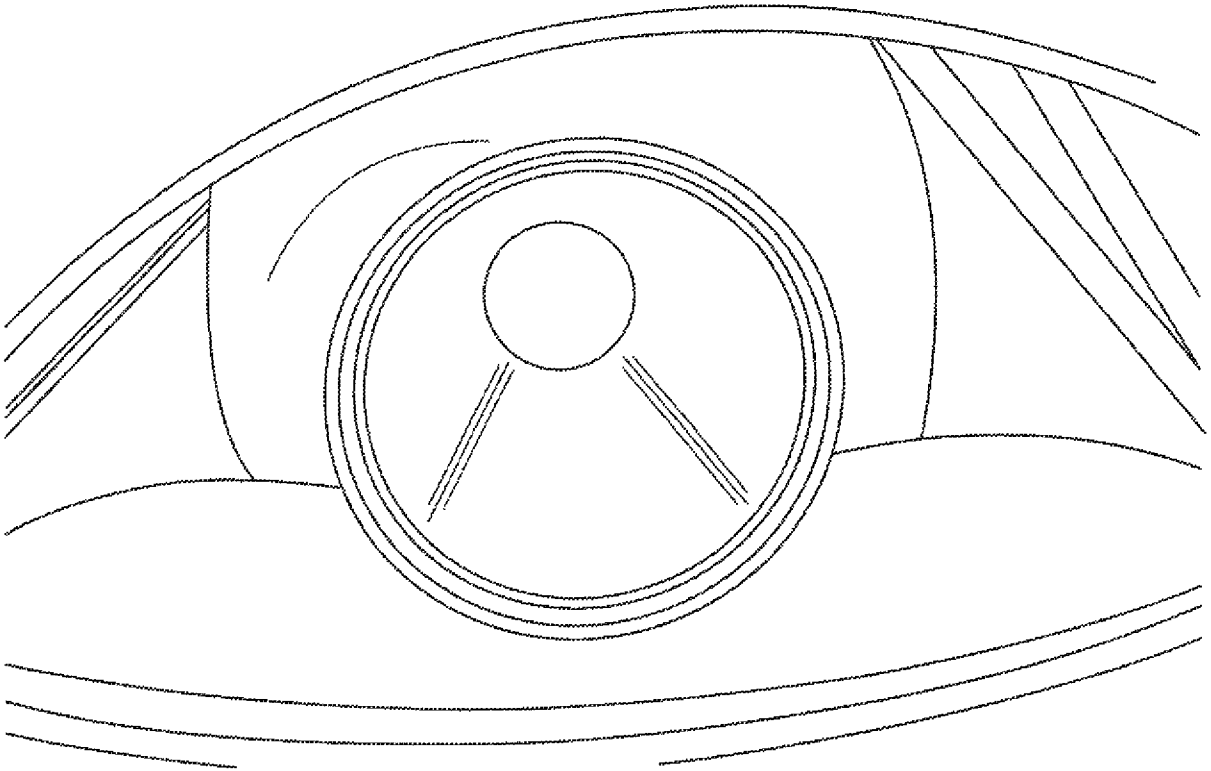

The invention will now be described, by way of example only, with reference to the accompanying drawings, in which:

FIG. 1 describes a typical spraying apparatus for applying the stabilising composition of the invention to the inner wall of a blasthole;

FIG. 2 describes a plan view of the spraying apparatus for applying the stabilising composition of the invention to the inner wall of a blasthole;

FIG. 3 demonstrates the results of the coating test of Example 1 wherein the stabilising composition of the invention has been applied to the inner wall of a cardboard pipe; and FIG. 4 demonstrates the results of the coating test of Example 2 wherein the stabilising composition of the invention has been applied to the inner wall of a PVC pipe.

Referring first to FIGS. 1 and 2, a spraying apparatus shown generally as 100 comprises a mixing chamber 1 which is supplied with two separate substances by two feed pipes (not shown) connected to a pair of non-return plugs 2 and hose connectors 3. The purpose of the non-return plugs 2 is to prevent the solidifying composition from passing back towards the feed pipes and blocking entry of the composition into the spraying apparatus 100. The apparatus 100 also comprises a spray tip (or spray head) 5 and a pressurisation source (not shown) attached to the apparatus via a pressurization connector 4.

The mixing chamber 1 is connected to the feed pipes via a staple lock hose connection area 6 which is linked to the mixing chamber 1 by a joiner piece 7. A nozzle shaft 8 links the mixing chamber 1 with the spray tip 5 which is configured to provide a conically shaped spraying pattern.

In use, the spraying apparatus 100 is inserted into the base of a blasthole and the mixing chamber 1 will mix the two classes of substance (e.g. the resin base composition and the hardener composition) supplied to the chamber 1 by feed pipes prior to pumping of the product mixture through the spray tip 5. The product mixture will typically be sprayed in an outwardly radial or fan-like manner in order to effectively coat the entire circumference of the inner wall of the blasthole prior to hardening. Once spraying commences, the spraying apparatus 100 will be retracted from the base of the blasthole to the opening of the blasthole in order to ensure that the entire inner wall of the blasthole is substantially coated with the stabilising composition. It will be appreciated that the spraying rate and the retraction rate will be readily apparent to the skilled person depending upon the nature of the mixture applied and the internal bore diameter of the blasthole.

EXAMPLE 1

Test Application of the Geothix™ Stabilising Composition to the Inner Wall of a Cardboard Pipe A Geothix™ composition was prepared as described in WO 02/094903. For example, a mixture of component A was prepared:

Component A
86.4% waterglass;
1.6% trimethoxysilane;
1% water;
1% alkyl polyglucoside;
8% glycerin; 0.2% defoamer;
0.8% dimethylaminoethoxyethanol; and
1% guanidine hydrochloride.

A mixture of component B was prepared:

Component B
66.5% Roh-MDI (polymeric diphenylmethanediisocyanate with a viscosity at 25<0>C from 200 mPa s);
10% propylene carbonate;
10% diisopropylnaphthaline; and
20% polypropylene glycol (Average MW 2000).

The components A and B were mixed together in the spraying apparatus shown in FIG. 1 and then applied to the inside of a 3 meter long cardboard pipe. Spraying was conducted at a spraying rate of 10 liters/minute and the spraying apparatus was retracted through the cardboard pipe at a retraction rate of 10 meters/minute.

The results of Example 1 are shown in FIG. 3 wherein it can be seen that a minimum thickness of stabilising composition (shown as feature 7 in FIG. 3) of 2 mm has been applied to the inner wall of the cardboard pipe (shown as feature 6 in FIG. 3). The coating of the 3 meter section of cardboard pipe was achieved in 15 seconds. It can be seen in FIG. 3 that the coating is substantially uniform across the length of the cardboard pipe, however, a thicker portion was obtained due to overspray caused by the cardboard pipe being positioned in a horizontal orientation.

EXAMPLE 2

Test Application of the Geothix™ Stabilising Composition to the Inner Wall of a PVC Pipe This experiment was performed in an analogous manner to that described in Example 1, except that a 15 meter section of a PVC pipe was sprayed with the composition in an arrangement to overcome the overspray problems demonstrated in FIG. 3. The results can be seen from the cross-sectional view shown in FIG. 4, wherein the coating is seen to be substantially uniform across the length of the pipe.

EXAMPLE 3

Test Application of the Carbofill™ Stabilising Composition to the Inner Wall of a Cardboard Pipe Example 3 may be performed in an analogous manner to that described in Example 1 except that a Carbofill™ stabilising composition may be applied to the inner wall of the cardboard pipe. The Carbofill™ composition may be prepared as described in WO 98/54243. For example, a resin component A may be prepared:

72.0 Parts by weight resole resin;

10.5 parts by weight water;

11.2 parts by weight flame retarding agent (50% aqueous potassium tri-polyphosphate); and 72.0 parts by weight magnesium hydroxide carbonate (with a bulk density of 75 g/l).

Acid component B may then be prepared: 44.0 parts by weight phenol sulfonic acid;

24.0 parts by weight sulphuric acid; and 32.0 parts by weight water.

Resin component A may then be mixed with acid component B in a mixing ratio of 100:25 (A:B) and applied to a cardboard pipe in order to achieve analogous results to that obtained in Example 1.

Although the present invention has been described with reference to preferred embodiments, workers skilled in the art will recognize that changes may be made in form and detail without departing from the spirit and scope of the invention.

The invention claimed is:

1. A method of stabilizing a blasthole which comprises the step of spraying the inner wall of the blasthole with a stabilizing composition after the blast hole has been drilled and prior to detonation wherein spraying provides a coating of the stabilizing composition on the inner wall of the blasthole.

2. A method as defined in claim 1 wherein the stabilizing composition comprises a silicate containing resin; a thermoset resin system comprising polyurethanes, polyesters, epoxides, or phenolics; a cement based mortar or material.

3. A method as defined in claim 1 wherein the stabilizing composition comprises a resin containing foam material.

4. A method as defined in claim 1 wherein the spraying step further comprises a coating step, wherein the coating step comprises a moveable spraying application of the stabilizing composition from a first position at a base of the blasthole to a second position at an opening of the blasthole.

5. A method as defined in claim 4 wherein the movement is variable and controllable.

6. A method as defined in claim 5 wherein the retraction rate is between 1 and 50 meters/minute.

7. A method as defined in claim 1 which comprises the steps of:

(a) moving a source of stabilizing composition from a proximal end of the blast hole to a distal end; and (b) moving the source from the distal end to the proximal whilst operating the source to coat an inner wall of the blasthole with the stabilizing composition.

8. A method as defined in claim 1 wherein the rate of spraying is variable and controllable.

9. A method as defined in claim 8 wherein the spraying rate is between 1 and 20 liters/minute.

10. A method as defined in claim 1 wherein the spraying step provides the inner wall of the blasthole with a coating of the stabilizing composition between 1 mm and 5 mm in thickness.

11. A method as defined in claim 1 wherein at least 60% of the total internal surface area of the blasthole is coated with the stabilizing composition.

12. A method as defined in claim 1 wherein the stabilizing composition comprises a polymeric composition.

13. A blasthole stabilization kit which comprises a stabilizing composition as defined in claim 2 and instructions to use said kit in accordance with the method of stabilizing a blasthole which comprises the step of spraying the inner wall of the blasthole with a stabilizing composition after the blast hole has been drilled and prior to detonation and wherein the kit additionally comprises a spraying apparatus which sprays the blasthole prior to detonation.

14. A kit as defined in claim 13 wherein the spraying apparatus comprises separate chambers containing a resin base composition and a hardener composition.

15. A kit as defined in claim 14 wherein the spraying apparatus comprises mixing means.

16. A kit as defined in claim 13 wherein the spraying apparatus comprises a spray head or nozzle.

17. A kit as defined in claim 13 wherein the spraying apparatus comprises a pump for spraying the stabilizing composition under high pressure.

18. A kit as defined in claim 13 which additionally comprises retraction means for moving and/retracting the spraying apparatus within the blasthole.

19. A kit as defined in claim 13 which additionally comprises means to control the spraying and/or retraction rates.

20. A blasthole stabilization kit which comprises a stabilizing composition as defined in claim 3 and instructions to use said kit in accordance with the method of stabilizing a blasthole prior to detonation which comprises the step of spraying the inner wall of the blasthole with a stabilizing composition after the blast hole has been drilled and prior to detonation and wherein the kit additionally comprises a spraying apparatus which sprays the blasthole prior to detonation.

* * * * *